United States Patent [19]

Gennep

[11] 4,151,981

[45] May 1, 1979

[54] BRAKE DRUM CONTROLLED HOIST

[76] Inventor: Jan V. Gennep, 715 Laurel Ave., Menlo Park, Calif. 94025

[21] Appl. No.: 841,307

[22] Filed: Oct. 12, 1977

[51] Int. Cl.[2] ..... B66D 1/00

[52] U.S. Cl. ..... 254/186 R; 254/187.4; 188/341

[58] Field of Search ..... 254/186 R, 168, 170, 254/174, 150 R, 187.4, 187.8, 169, 167, 175; 188/325, 341, 328; 242/54 R; 192/7, 17 R, 15

[56] References Cited

U.S. PATENT DOCUMENTS

| | | | |
|---|---|---|---|
| 1,438,394 | 12/1922 | Packer | 254/186 R |
| 2,238,254 | 4/1941 | Dick | 188/341 |
| 2,433,692 | 12/1947 | Geer | 254/170 |
| 3,467,359 | 9/1969 | Durand | 254/186 R |
| 3,572,482 | 3/1971 | Kalpas | 254/187.4 |
| 3,677,376 | 7/1972 | Barajas | 188/341 |
| 3,850,380 | 11/1974 | Kranefeld | 242/54 R |
| 3,994,476 | 11/1976 | Gennep | 254/186 R |

*Primary Examiner*—Trygve M. Blix
*Assistant Examiner*—Kenneth W. Noland
*Attorney, Agent, or Firm*—C. Michael Zimmerman

[57] ABSTRACT

A hoist is described which combines a block and tackle with a windlass. A drum brake and operating linkage therefor incorporated into the hoist is to automatically provide braking to prevent a load from causing unwanted reverse rotation of the windlass. Lowering of the load is achieved by applying against the pressure of the brake sufficient reverse rotational force to overcome the brake resistance and cause lowering. The brake shoes have a common pivot point whose location with respect to the brake drum can be changed to adjust the relative degree of braking provided by each of the shoes. The hoist also includes mechanism which prevents the hoist line from being wrapped around the hoist in a direction which would render the brake applying linkage ineffective.

5 Claims, 7 Drawing Figures

BRAKE DRUM CONTROLLED HOIST

BACKGROUND OF THE INVENTION

The present invention relates to hoists and the like and more particularly to a hoist and method of adjusting same to enable relatively heavy loads to be raised with a minimum of input force.

U.S. Pat. No. 3,994,476 issued Nov. 30, 1976 to applicant describes and claims a hoist having a braking arrangement designed to be applied by a load supported on the line wound around the hoist windlass. The subject matter of such patent is hereby incorporated by reference. Lowering of the load, i.e., reverse rotation of the windlass, is achieved by applying torque to the windlass to rotate the same through the brake in the reverse direction. That is, the brake remains applied even when the windlass is rotated in the reverse direction. Thus, the operator is assured that the hoist will not allow the load to be dropped, even if the power mechanism causing reverse rotation of the windlass fails.

The hoist principles described and claimed in applicant's earlier patent readily lend themselves to incorporation into a hoist embodiment that is motor driven. Most motor driven hoists, though, include a relatively powerful motor incorporated directly therein. This makes such a hoist expensive, and significantly reduces the likelihood of it being used for many applications. It has long been recognized that it would be desirable to be able to drive a hoist with a low powered separable motor, such as is incorporated in a hand drill without a too large and complicated gear speed reduction unit. However, since the power of the hoist motor in most arrangements is used not only to raise a load, but also to provide braking during load lowering, it has not been practical to do so.

SUMMARY OF THE INVENTION

The present invention relates to improvements to the hoist described in U.S. Pat. No. 3,994,476 which enable the same to be effectively and safely operated to lift relatively heavy loads with a low powered motor, e.g., one ton loads with a 1000 r.p.m., 3.2 to 4 amp motor. Thus, a hoist arrangement which can be operated with a simple hand drill is now practical.

In its basic aspects, the hoist of the invention includes a frictional brake for the windlass having at least a pair of friction braking members e.g., a pair of opposed brake shoes which frictionally engage a brake drum surface. Means are also included to enable application to the windlass of sufficient reverse rotational force to overcome the resistance against windlass reverse rotation provided by the brake. As a particularly salient feature of the instant invention, it also includes means to adjust between the pair of friction members, the relative degree of braking provided by each. That is, in order to enable a relatively low powered motor to drive the windlass, it is important that the amount of power required to lower the load be not appreciably different than the amount of power required to raise such load. It has been found that when a pair of opposed brake shoes are used to provide the braking, the amount of frictional force provided by the brake to hold the load against reverse rotation is dependent upon the degree of braking provided by each of the shoes. Thus, the ability to adjust the degree of braking provided by both the shoes enables each individual hoist incorporating the invention to be simply and quickly adjusted to enable operation with a low powered motor, such as is found in a hand drill.

The invention also includes as part of the hoist, means to prevent winding of the line about the windlass in the wrong direction. As can be seen from applicant's earlier patent and will become more apparent from the following description of a preferred embodiment, the means which applies the brake automatically whenever a load is on the hoist, is dependent upon the hoist line being wound about the hoist windlass in a particular direction. The inclusion in the combination of means which operates to prevent the line from being wound about the windlass in the wrong direction assures that the automatic brake operating mechanism of the invention is not inadvertently circumvented.

The invention includes other features and advantages which will be described or will become apparent from the following more detailed description.

BRIEF DESCRIPTION OF THE DRAWING

With reference to the accompanying two sheets of drawing.

DETAILED DESCRIPTION OF THE PREFERRED EMBODIMENT

Figure 1:
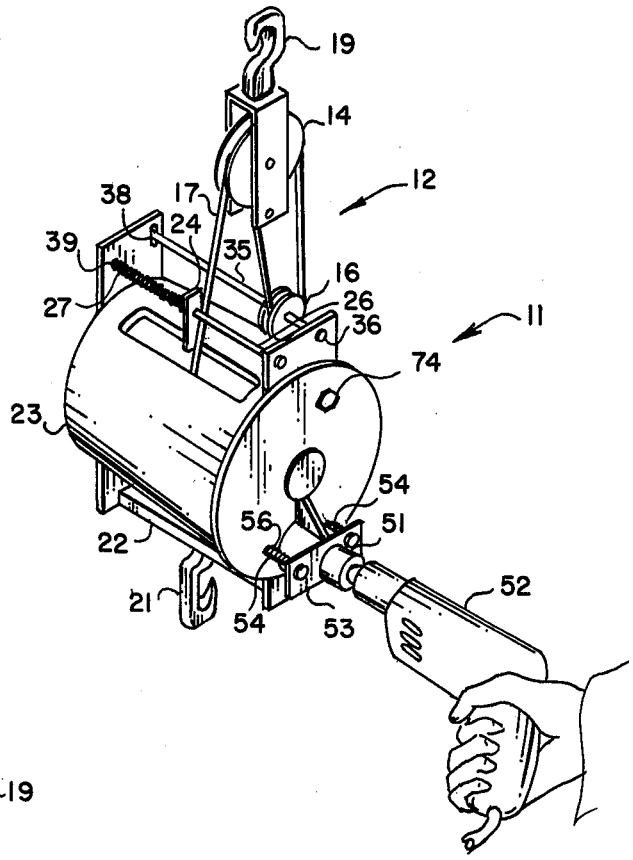
FIG. 1 is an overall isometric view of a preferred embodiment of the hoist of the present invention with a hand drill motor in position to drive the same.

A hoist incorporating a preferred embodiment of the invention is generally referred to in the drawing by the reference numeral 11. Such hoist is based on the same principles as the hoist described and claimed in applicant's U.S. Pat. No. 3,994,476. That is, such hoist includes a block and tackle 12 combined with a windlass 13 for taking up and paying out the block and tackle line. It also includes the same basic brake operating mechanism for controlling windlass rotation. As illustrated, the block and tackle includes upper and lower pulleys 14 and 16, respectively, about which a line in the form of a cable 17 is threaded to provide a mechanical advantage of three. The windlass includes a drum 18 about which the line 17 is wound. A hook 19 projects upwardly from the block of pulley 14 to act as means to securing the hoist to a support. Another hook 21 depends downwardly from a bar 22 which is rigidly secured to a housing 23 for the windlass 13. The hook 21 is for the purpose of securing a load to the windlass.

From the above it will be appreciated that rotation of the windlass 13 will result in the line 17 being wound or unwound on drum 18 and, hence, being taken in or paid out. Such taking in or paying out of the line will operate the block and tackle 12 to raise or lower the windlass 13 and its housing 23 and, hence, any load which is secured thereto via, for example, hook 21.

Means are included to assure that line 17 is wound uniformly along drum 18 on rotation of the windlass. More particularly, a pressure plate 24 is slidably mounted on a mounting rod 26 and is maintained in engagement with line 17 by a coil spring 27 which is under compression. Plate 24 urges line 17 in a direction which results in the adjacent wrapping of the line 17 about the drum being positioned closely adjacent one another. This assures that the changes which occur in the relationship of the line to the drum during taking in and paying out of the line, are repeatable — thus simplifying the engineering for the hoist required because the point at which the line first engages the drum changes relative to the position of the hooks 19 and 21.

Figure 4:
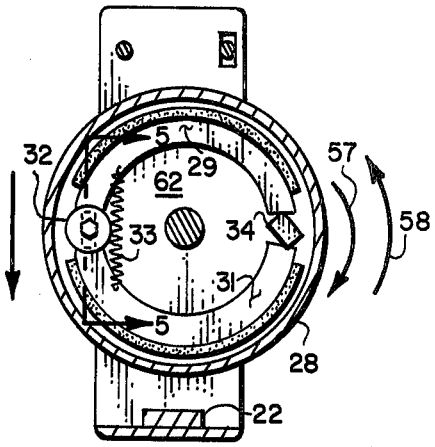
FIG. 4 is a sectional view taken on the plane indicated by the lines 4—4 in FIG. 2.
Figure 5:
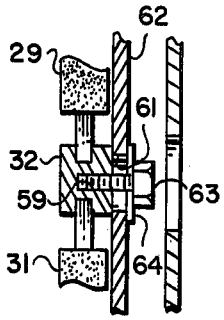
FIG. 5 is an enlarged partial sectional view taken on a plane indicated by the lines 5—5 in FIG. 4; and FIGS. *6a* and *6b* are partial sectional views illustrating in two different positions the lock out arrangement of the preferred embodiment which prevents the line from being wrapped around the windlass in the wrong direction.

A brake arrangement is included to automatically prevent unwanted reverse rotation of the windlass, i.e., load caused rotation of the windlass. A conventional drum brake of the mechanical type is incorporated into the hoist to provide the actual braking. That is, a brake drum 28 is rigidly secured to the drum 18 for rotation therewith, and a brake shoe assembly which includes a pair of opposed brake shoes 29 and 31 is secured to the housing 23 for limited rotational movement with respect thereto. As can best be seen from FIGS. 4 and 5, brake shoes 29 and 31 are mounted for pivotal motion against the internal cylindrical surface of the brake drum to provide frictional braking. Specifically, each of the brake shoes 29 and 31 is arcuate and has one end held by a boss 32 which provides, in effect, a common pivot point for the shoes. Boss 32 has opposed slots within which the respective shoe ends are fitted and, as is conventional, such shoe ends are maintained in such slots by a compression spring 33 secured in tension between the shoes.

The brake is applied, i.e., the brake shoes are pivoted against the brake drum surface, by camming action. That is, a brake operating cam 34 is positioned between the ends of the shoes 29 and 31 distal from the ends held by boss 32. Such cam is shaped to engage the brake ends and spread the same apart when it is rotated. As is conventional, the cam is shaped to make the degree of pivotal pressure it applies to the brake shoes proportional to its degree of rotation. That is, the greater the rotational torque applied to the cam 34, the greater the braking action.

The braking arrangement is adapted to apply the brake in response to a load on the windlass tending to cause reverse rotation thereof. More particularly, one end of a load sensing arm 35 is pivotally mounted at 36 to the housing 23, and the other end 37 thereof extends through a vertical slot 38 in a plate 39 projecting upward from the main body of the housing. As can best be seen from FIGS. 2 and 3, a linkage link 41 connects arm end 37 to an actuator lever arm 42. Arm 42 is connected via a stud 43 (FIG. 2) to the brake operating cam 34. Such arm is rigidly secured to the stud 43 and is mounted on the housing via such stud for pivotal motion about the longitudinal axis of the stud. Such stud is correspondingly rigidly secured to the cam 34 so that pivotal motion of the actuator lever arm 42 will cause a corresponding rotation of the cam 34.

As illustrated, link 41 is connected to arm 42 at a location at which upon upward movement of such arm in response to a load being applied to the hoist, it will rotate the arm 42 counter-clockwise. Such rotation will cause cam 34 to separate the brake shoes and, hence, apply the brake. The degree of brake application, i.e., the amount of applied brake pressure, will be proportional to the upward force on the link provided by the weight of the load since the lever arm will be urged upwardly proportionate to such load force.

Brake operation under the various conditions of the hoist is the same as that of the hoist described and claimed in applicant's earlier U.S. Pat. No. 3,994,476. That is, when no weight or load has been applied to the windlass the brake will be essentially disengaged so that the windlass is free to rotate. It should be noted, however, that a coil spring 44 is connected in tension between the free end of arm 42 and the windlass housing to provide a constant application of slight brake pressure for windlass rotation control and initial operation of the brake.

As discussed previously, when a load is applied to the windlass, the brake will be applied with a force proportional to the load force. When it is desired to raise the load by applying forward rotational force to the windlass in the manner to be described, the brake mechanism will first respond to the rotational force by rotating clockwise slightly so that the end 37 of arm 35 engages the upper end of slot 38. As discussed in applicant's earlier patent, this will result in the force of the load being transferred from the brake operating linkage to the housing so that the brake will be rendered substantially ineffective and further rotational torque can raise the load without significant brake resistance.

When it is desired to lower the load, sufficient reverse rotational force is applied to the windlass to cause such reverse rotation even though the brake is applied. That is, sufficient reverse rotational force will be applied to overcome the brake pressure resistance. In this connection, it must be remembered that the load itself will provide a force tending to cause reverse rotation. It is therefore only necessary to add to such load force the amount of additional rotational force needed to cause lowering. As explained in applicant's earlier patent, the amount of such force necessary for load lowering can be varied by changing the location of the pulley 16 on the load sensing arm 35. However, as will be discussed more fully below, it is desirable that other initial adjustments also be made to appropriately select the amount of additional rotational force needed to lower specified loads. This may require additional pulley location adjustment.

The means to apply torque to the windlass and intentionally rotate the same includes a torque input device in the form of a hexagonally shaped head 46 on the exposed end of a shaft 47 which extends through housing 23 and is journalled for rotation with respect thereto. The end 48 of the shaft 47 within the housing is provided with teeth. Such teeth on shaft end 48 engage complementary teeth on the periphery of an idler spoke gear 49 which is rigidly secured to the drum 18. The gear 49 and pinion provided by the shaft end 48 act, in effect, as a gear speed reduction train which extends between the input torque head 46 and the windlass. Such train will amplify any torque which is applied to the windlass through the train and, hence, reduce the amount of power which must be applied to rotate the windlass to cause the hoist to lift a given load. However, such gear train provides a relatively small speed reduction, e.g., 18 to 1.

Rotation of the gear train and, hence, of the windlass is achieved by engaging the shaft head 46 with a complementary torque output device. For example, as is illustrated in FIG. 1, the head 46 can be engaged by a mating socket 51 on the output shaft of a conventional hand drill 52. Drill 52 is preferably one selectively providing both forward and reverse rotation so that it can be used to rotate the windlass in either direction as needed to raise or lower a load.

Means are included to prevent rotation of the gear train unless the head 46 is engaged by a complementary torque output device, such as by the socket 51. That is, a lockout plate 53 having a central aperture having a peripheral configuration complementary to the peripheral configuration of the head 46 is mounted to be resiliently urged to a position in which its central aperture receives the head 46, as illustrated in solid in FIG. 2. That is, plate 53 is mounted for sliding movement on a pair of parallel pins 54 positioned on opposite sides of the boss of the housing through which the shaft 47 extends. Pins 54 will prevent the plate 53 from rotating with respect to the housing 23, but will enable the same to be moved inwardly and outwardly with respect thereto. Each of the pins 54 is surrounded by a coil spring 56 which is maintained in compression between the housing and the plate 53, with the result the plate is urged as previously mentioned into the position shown in solid in FIG. 2 in which the head 46 is received within the central aperture of the plate.

Figure 2:
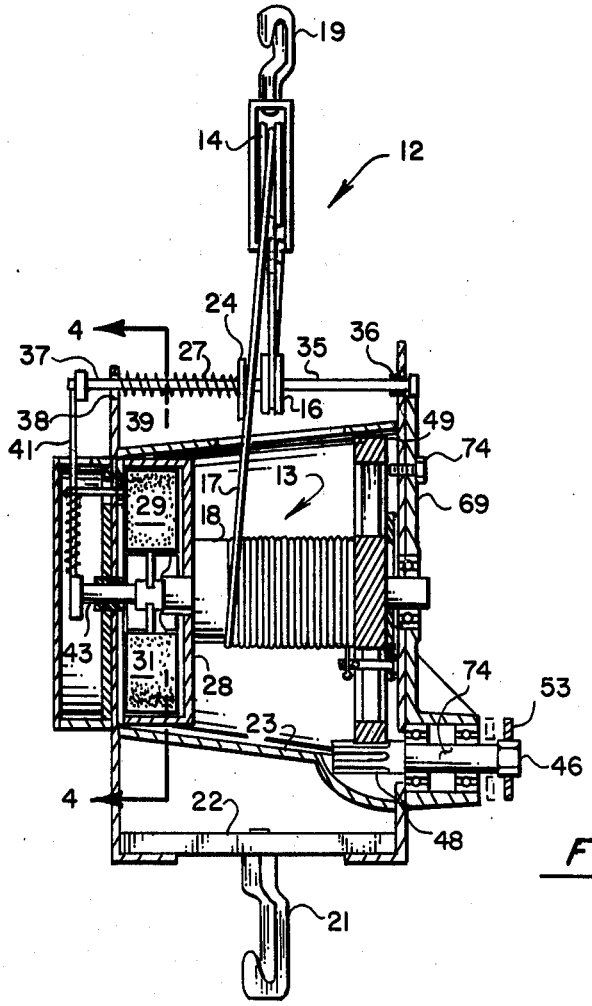
FIG. 2 is a side sectional view illustrating details of the construction of the preferred embodiment of FIG. 1.
Figure 3:
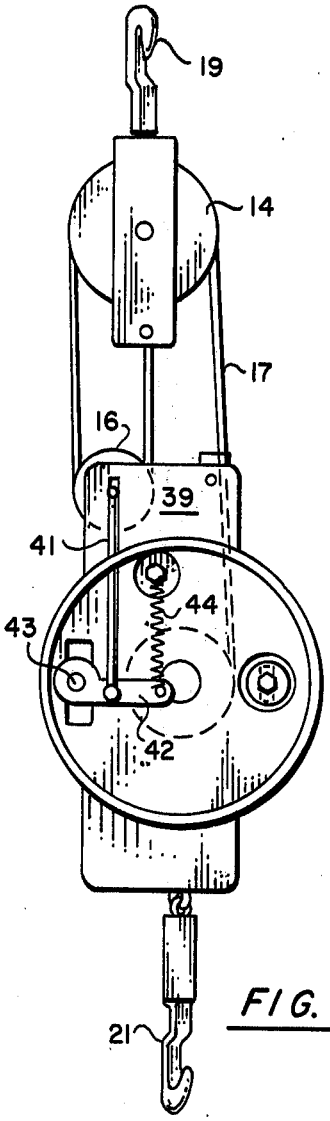
FIG. 3 is an end view of the embodiment of FIG. 1 with a plate removed to expose details of the brake applying mechanism thereof.

It will be recognized from the above that when the plate is in the position shown in solid in FIG. 2, it will prevent rotation of the shaft 47 and, hence, of the gear speed reduction train, since the peripheral configuration of the central aperture of the plate is complementary to the peripheral configuration of the head 46. When a torque output device, such as the socket 51, is inserted over the head 46, though, it will force the plate 53 against the compression of springs 56 into the dotted line position shown in FIG. 2. As illustrated, the shaft adjacent such position has a reduced diameter so that the shaft will be free to rotate within the central aperture. Thus, the engagement of the head 46 with a torque output device will automatically disengage the lockout mechanism provided by the plate 53 and its attendant structure, which lockout mechanism will automatically again become effective when the socket 51 is disengaged from the head 46 due to the presence of springs 56.

The amount of braking provided by a mechanical drum brake of the type incorporated into the hoist is not the same for opposite directions of rotational force. That is, if a brake of such type is applied with a uniform pressure, it typically requires more force to rotate the drum in one direction than in the other. This is so because the brake shoes have slightly different lining thicknesses, frictional properties, etc. Moreover, the brake shoes will individually "wrap" into the drum, depending upon the direction of rotation. For a better understanding of this, reference is made to FIG. 4. When the brake drum 28 rotates clockwise as indicated by the arrow 57, i.e., in the direction of rotation associated with reverse rotation of the windlass, brake shoe 31 will be wrapped into the drum. That is, rotation of the drum will tend to cause a corresponding clockwise rotation of the shoe 31 and further application of the brake. The force tending to cause such reverse rotation, though, will not cause the shoe 29 to be correspondingly wrapped into the drum and thus a slight difference in the braking provided by the two shoes occurs. On drum 28 rotating counterclockwise as indicated by arrow 58, i.e., in the direction of forward rotation of the windlass, engagement of the drum with the lining of shoe 29 will tend to cause such shoe, rather than shoe 31, to be wrapped into the drum. This differential braking dependent upon the direction of rotational force on the drum can materially affect the operation of the hoist with low powered input. It may be, for example, that a particular power input will be sufficient to cause rotation of the windlass to raise a specified load, whereas it would be insufficient to lower the load irrespective of the position of pulley 16 on load sensing arm 35.

As a particularly salient feature of the instant invention, it includes a mechanism and method for eliminating in a simple manner the differential braking associated with the different directions of rotational force. More particularly, it has been found that the problem can be essentially eliminated by adjusting the relative degree of braking provided by each of the shoes. Preferably, it is adjusted so that the shoe which wraps into the drum to prevent reverse rotation of the windlass, shoe 31, provides substantially all of the braking. As used herein, the phrase "substantially all" of the brake means the great majority, e.g., 80%, of such braking. When it is stated herein, though, that "essentially all" of the braking is provided by one of the brake shoes, it is meant that for all practical purposes all of the braking is provided by such shoe.

To enable adjustment of the relative degree of braking provided by the shoes 29 and 31, the hoist of the invention includes means for changing the relative location of the pivot point of each of the shoes. More particularly, as best seen from FIG. 5, boss 32 providing a common pivot point for the shoes has a mounting bolt 59 which extends through a slot 61 in the brake backing plate 62. Such mounting bolt terminates in a head 63 which compresses a washer 64 against backing plate 62 to maintain the boss 32 and, hence, the common pivot point of the shoes, in a selected location.

The method of adjusting the position of the shoes to obtain the desired effect, is quite simple. Such adjustment typically is made after the hoist is assembled but prior to the time it is placed into use. The location of the common pivot point is first adjusted to provide essentially all of the braking by engagement of the drum surface with the shoe, shoe 31, which will wrap into the drum whenever a rotational force urges it in the direction of reverse rotation of the windlass. This is accomplished by loosening bolt 59 and moving the boss downward as viewed in FIG. 4 to the extent one manually can do so. The bolt is then tightened to rigidly fix the pivot point at such position. A load selected to be one which can be raised with the amount of torque power available, is then applied to the windlass. Such load is then raised by applying forward rotational torque to the torque input head 46. In this connection, it will be recalled that during the raising operation, the brake will be rendered ineffective by the load sensing arm engaging the upper end of the slot 38. However, discontinuation of the torque will result in application of the brake with essentially all of the braking pressure being provided by the shoe 31. The location of the common pivot point is then adjusted to permit the load to be lowered. That is, the position of the common pivot point is "backed-off" from its extreme position to enable reverse rotation to lower the load. It is preferably backed off so that substantially the amount of input torque is required to lower the load as is required to raise it. It should be noted that although the pivot point will be backed-off from its extreme position, it is believed that substantially all of the braking will still be provided by the shoe 31.

As another salient feature of the instant invention, it includes means which assures that line 17 can be wrapped around the windlass in only one direction. In this connection, it will be recognized that proper operation of the brake applying mechanism depends upon the windlass 13 being urged to rotate in a counterclockwise direction as viewed in FIG. 3, by a load being applied thereto. However, it will also be recognized that if the windlass is rotated in such direction sufficiently to pay out the line 17 fully, further rotation will tend to wrap the line around the drum in the opposite direction. Load raising will then be caused by application of torque through the braking resistance of the brake arrangement. On the application of torque tending to lower the load, the brake will be rendered ineffective with possible disastrous results.

Figure 6A:
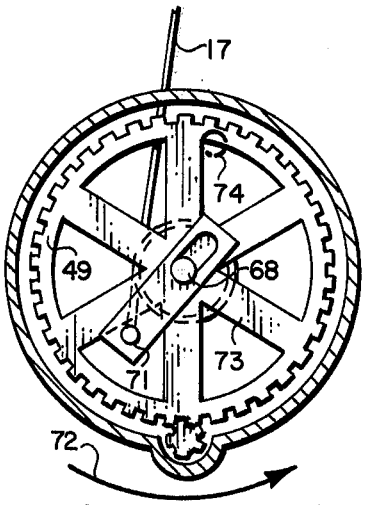
Figure 6B:
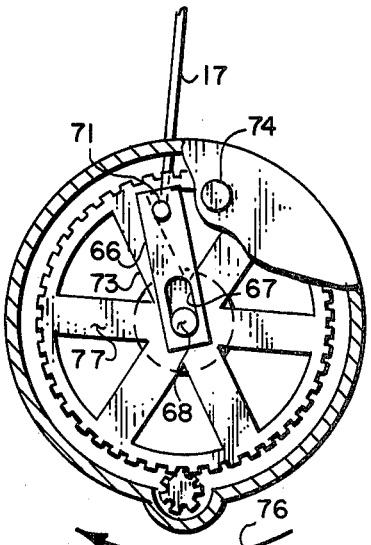

As best illustrated in FIGS. 6*a* and 6*b*, the means which will prevent winding of the line about the windlass in the wrong direction includes anchor means for the end of the line in the form of a plate 66. Plate 66 is mounted via a slot 67 on the axle 68 of the idler spoke gear 49 at a location between such gear and housing end plate 69. A pin 71 extending from the free end of such plate through the spokes of the idler gear has the end of the line 17 secured thereto. On rotation of the windlass in the direction of arrow 72 in FIG. 6*a*, the spoke 73 of the idler gear will engage the pin 71 and cause rotation of plate 66 therewith. This will result in the line being wrapped around the drum in the correct direction for proper action of the brake applying linkage. In this connection, it should be noted that rotation in such direction will result in the force being applied to the anchor plate to assure that gear axle 68 will be positioned at the inner end of slot 67, i.e., the anchor plate will be in a "retracted" position.

The slot-axle mounting of the plate will provide an automatic change in the relative positions of the plate and the idler gear when the line 17 is fully paid out. That is, as is illustrated in FIG. 6*b*, when the windlass is rotated to such an extent that line 17 is fully paid out, the force on the line 17 tending to pull the same away from the windlass will cause plate 66 to move to an extended position relative to the axle 68. Obstruction means are included to engage the anchor plate and prevent further rotation of the windlass in such direction. More particularly, a stud 74 is rigidly secured in the housing plate 69 and projects into the path of rotation of the plate 66 when it is in such extended position. This can be seen by referring to FIG. 6*b*. If torque is applied to the windlass to rotate the same further in the direction represented by arrow 76, the plate 66 will engage the stud 74, and the spoke 77 of the idler gear will engage the pin 71 — thus preventing such rotation. Of course, when torque is applied to the windlass tending to rotate the same in the direction indicated by arrow 72 in FIG. 6*a*, the pull on line 17 will apply force to the plate 66 and move the same to its retracted position illustrated in such figure in which it will clear stud 74.

Although the invention has been described in connection with a preferred embodiment thereof, it will be appreciated by those skilled in the art that various changes and modifications can be made without departing from its spirit. It is therefore intended that the coverage afforded applicant be limited only by the claims and their equivalents.

I claim:

1. A hoist or the like comprising a windlass which is selectively rotatable in forward and reverse directions respectively to take in or pay out a line; a housing for said windlass which remains stationary with respect thereto upon rotation of said windlass; and a brake arrangement to automatically prevent unwanted reverse rotation of said windlass by a load, said brake arrangement comprising a drum brake having a pair of opposed brake shoes mounted adjacent corresponding first ends at a common pivot point for pivotal motion against a brake drum surface to provide frictional braking, load sensing means to which said load is applied mounted on said housing for movement upon any load tending to cause reverse rotation being applied to said sensing means, a lever arm actuator for said frictional brake, and linkage connecting said load sensing means to said actuator for transmitting the motion of said load sensing means to said actuator, said lever arm actuator being operatively connected to the second ends of both of said brake shoes to pivot said shoes to generally the same distance to provide said frictional braking; and means to change the relative location of said common pivot point with respect to said brake drum surface to vary the relative engagement of said brake shoes with said drum.

2. A hoist or the like comprising a windlass which is selectively rotatable in forward and reverse directions respectively to take in and pay out a line wound therearound in one direction; a brake arrangement to automatically prevent unwanted reverse rotation of said windlass by a load, said brake arrangement comprising a frictional brake having at least a pair of friction braking members; means to enable application against the pressure of said brake arrangement of sufficient reverse rotational force to overcome the resistance of said brake pressure to reverse rotation of said windlass; means to adjust between said pair of friction braking members the relative degree of braking provided by each; anchor means to which said line is secured connected to said windlass for rotation therewith, the connection between said anchor means and windlass enabling an automatic change in the relative positions of said anchor means and windlass when said line is fully paid out from said windlass; and obstruction means engagable with said anchor means to prevent rotation of said windlass in the opposite direction to the direction in which said line is wound about said windlass, after said line is fully paid out.

3. A hoist or the like commprising a windlass which is selectively rotatable in forward and reverse directions respectively to take in or pay out a line wound therearound in one direction; a housing for said windlass which remains stationary with respect thereto upon rotation of said windlass; a brake arrangement to automatically prevent unwanted reverse rotation of the windlass by a load, comprising a frictional brake on said windlass, load sensing means to which said load is applied mounted on said housing for movement upon any load tending to cause said reverse rotation being applied thereto, a lever arm actuator for said frictional brake, and linkage connecting said load sensing means to said actuator for transmitting the motion of said load sensing means to said actuator to apply said frictional brake; means to enable application against the pressure of said brake arrangement of sufficient reverse rotational force to overcome the resistance of said brake pressure to reverse rotation of said windlass; anchor means to which said line is secured connected to said windlass for rotation therewith, the connection between said anchor means and windlass enabling an automatic change in the relative positions of said anchor means and windlass when said line is fully paid out from said windlass; and obstruction means engagable with said anchor means to prevent rotation of said windlass in the opposite direction to the direction in which said line is wound about said windlass, after said line is fully paid out.

4. A method of adjusting a hoist or the like which includes a windlass selectively rotatable in forward and reverse directions respectively to take in or pay out a line, a brake arrangement to automatically prevent unwanted reverse rotation of said windlass by a load comprising a drum brake having a pair of opposed brake shoes which engage a brake drum surface to provide frictional braking, and means to enable application against the pressure of said opposed brake shoes on said brake drum surface of sufficient reverse rotational force to overcome the resistance provided by said drum brake to reverse rotation of said windlass; said method comprising the step of adjusting the position of said shoes relative to said brake drum surface to cause substantially all of said braking to be provided by the one of said shoes which wraps into said drum to prevent reverse rotation of said windlass.

5. A method of adjusting a hoist or the like which includes a windlass selectively rotatable in forward and reverse directions respectively to take in or pay out a line, a brake arrangement to automatically prevent unwanted reverse rotation of said windlass by a load comprising a drum brake having a pair of opposed brake shoes mounted on a common pivot point for pivotal motion against a brake drum surface to provide frictional braking, and means to enable application against the pressure of said brake arrangement of sufficient reverse rotational force to overcome the resistance of said brake pressure to reverse rotation of said windlass including a torque input device engagable by a complementary torque output device; said method comprising the steps of adjusting the location of said common pivot point to provide essentially all of the braking by engagement with said drum surface of the one of said shoes which wraps into said drum to prevent reverse rotation of said windlass, applying a load to said windlass, and thereafter adjusting the location of said common pivot point to vary the relative engagement of said brake shoes with said drum so that substantially the same amount of input torque is required to pay out said line as is required to take in said line.

* * * * *